US007518105B2

(12) United States Patent
Dahl et al.

(10) Patent No.: US 7,518,105 B2
(45) Date of Patent: Apr. 14, 2009

(54) CONTINUOUS SAMPLING ION MOBILITY SPECTROMETERS AND METHODS THEREFOR

(75) Inventors: David A. Dahl, Idaho Falls, ID (US); Jill R. Scott, Idaho Falls, ID (US); Anthony D. Appelhans, Idaho Falls, ID (US); Timothy R. McJunkin, Idaho Falls, ID (US); John E. Olson, Rigby, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 377 days.

(21) Appl. No.: 11/610,609

(22) Filed: Dec. 14, 2006

(65) Prior Publication Data

US 2008/0142697 A1 Jun. 19, 2008

(51) Int. Cl.
*H01J 49/40* (2006.01)
*H01J 49/00* (2006.01)

(52) U.S. Cl. ..... 250/286; 250/281; 250/282; 250/299

(58) Field of Classification Search ..... 250/281–283, 250/286–290, 293, 299
See application file for complete search history.

(56) References Cited

U.S. PATENT DOCUMENTS

| | | | | |
|---|---|---|---|---|
| 5,796,100 | A | 8/1998 | Palermo | |
| 6,100,521 | A | 8/2000 | Doring et al. | |
| 6,627,883 | B2 * | 9/2003 | Wang et al. | 250/292 |
| 6,646,258 | B2 | 11/2003 | Russ, IV | |
| 6,649,911 | B2 | 11/2003 | Kawato | |
| 6,670,606 | B2 * | 12/2003 | Verentchikov et al. | 250/287 |
| 6,674,067 | B2 | 1/2004 | Grosshans et al. | |
| 6,674,071 | B2 | 1/2004 | Franzen et al. | |
| 6,690,005 | B2 | 2/2004 | Jenkins et al. | |
| 6,700,116 | B2 | 3/2004 | Taniguchi | |
| 6,713,757 | B2 | 3/2004 | Tanner et al. | |
| 6,727,496 | B2 * | 4/2004 | Miller et al. | 250/287 |
| 6,815,669 | B1 * | 11/2004 | Miller et al. | 250/286 |
| 6,888,128 | B2 | 5/2005 | Krasnobaev et al. | |
| 7,038,216 | B1 * | 5/2006 | Dahl et al. | 250/423 R |
| 7,119,328 | B2 * | 10/2006 | Kaufman et al. | 250/281 |
| 7,217,920 | B2 * | 5/2007 | Miller et al. | 250/287 |
| 7,259,369 | B2 * | 8/2007 | Scott et al. | 250/287 |
| 7,456,390 | B2 * | 11/2008 | Miller et al. | 250/287 |
| 2003/0034449 | A1 * | 2/2003 | Miller et al. | 250/287 |
| 2004/0232325 | A1 * | 11/2004 | Miller et al. | 250/287 |
| 2004/0240843 | A1 * | 12/2004 | Miller et al. | 386/46 |
| 2005/0040330 | A1 * | 2/2005 | Kaufman et al. | 250/293 |
| 2006/0169886 | A1 * | 8/2006 | Miller et al. | 250/287 |
| 2006/0192102 | A1 * | 8/2006 | Miller et al. | 250/286 |
| 2008/0142697 | A1 * | 6/2008 | Dahl et al. | 250/282 |
| 2008/0142700 | A1 * | 6/2008 | Dahl et al. | 250/286 |

* cited by examiner

*Primary Examiner*—Bernard E Souw
(74) *Attorney, Agent, or Firm*—Fennemore Craig, PC

(57) ABSTRACT

An ion mobility spectrometer may include a flow channel having an inlet end and an outlet end. A deflection electrode is positioned within the flow channel so that a non-linear electric field is created between at least a portion of the flow channel and at least a portion of the deflection electrode when an electrostatic potential is placed across the deflection electrode and the flow channel. The ion mobility spectrometer also includes means for producing ions at a position upstream from the leading edge of the deflection electrode, so that ions produced thereby are deflected by the deflection electrode into the non-linear electric field. A detector positioned within the flow channel for detects ions from the non-linear electric field.

25 Claims, 11 Drawing Sheets

CONTINUOUS SAMPLING ION MOBILITY SPECTROMETERS AND METHODS THEREFOR

GOVERNMENT RIGHTS

This invention was made with United States Government support under Contract No. DE-AC07-05ID14517 awarded by the United States Department of Energy. The United States Government has certain rights in the invention.

TECHNICAL FIELD

This invention relates to ion mobility spectrometry in general and more specifically to methods and apparatus for performing continuous ion mobility spectrometry.

BACKGROUND OF INVENTION

Ion mobility spectrometry is a technique that separates and detects electrically charged particles (e.g., ions) that have been sorted according to how fast they travel through an electrical field in a chamber containing a gas, typically at atmospheric pressure. Small ions travel through the gas faster than do large ions and reach the end of the chamber first, with successively larger ions arriving later. Because ion mobility spectrometry only sorts ions by size, and not by their chemical properties or other identifying features, it cannot be used in all cases to make a positive identification of unknown compounds. However, ion mobility spectrometers can be used with certain compounds and can make measurements quite rapidly (e.g., in only a few seconds), therefore making them highly desirable for use in certain applications. For example, ion mobility spectrometers are commonly used to detect explosives, narcotics, and chemical warfare (e.g., nerve and blister) agents.

A typical ion mobility spectrometer comprises an ionization region, a drift chamber, and a detector. The ionization region is located at one end of the drift chamber, while the detector is located at the other end of the drift chamber. The ionization region is typically provided with a radioactive source, such as $^{63}$Ni, suitable for ionizing the sample material, although other ionizing techniques may be used. Ions of the sample material from the ionization region are introduced into the drift chamber, whereupon they ultimately reach the detector at the far end. The arriving ions cause the detector to generate electrical pulses which may thereafter be interpreted to form a conclusion about the nature of the sample material.

SUMMARY OF THE INVENTION

An ion mobility spectrometer according to one embodiment of the invention may include a flow channel having an inlet end and an outlet end. A deflection electrode is positioned within the flow channel so that a non-linear electric field is created between at least a portion of the flow channel and at least a portion of the deflection electrode when an electrostatic potential is placed across the deflection electrode and the flow channel. The ion mobility spectrometer also includes means for producing ions at a position upstream from the leading edge of the deflection electrode, so that ions produced thereby are deflected by the deflection electrode into the non-linear electric field. A detector positioned within the flow channel for detects ions from the non-linear electric field.

Also disclosed is a method for ion mobility spectrometry that includes the steps of: Establishing a flow of a carrier gas in a flow channel containing a deflection electrode, the carrier gas comprising entrained amounts of a sample material; placing an electrostatic potential between the flow channel and the deflection electrode to produce a non-linear electric field between at least a portion of the deflection electrode and at least a portion of the flow channel; ionizing at least a portion of the sample material entrained in the carrier gas at a position upstream from the deflection electrode to produce ions of the sample material in the flow of the carrier gas, the ions being carried in the flow of carrier gas and being deflected by the deflection electrode into the non-linear electric field; and detecting ions after the ions have traveled through at least a portion of the non-linear electric field.

BRIEF DESCRIPTION OF THE DRAWING

Illustrative and presently preferred embodiment of the invention are shown in the accompanying drawing in which:

FIG. 1(*a*) is an enlarged cross-sectional view in elevation of a portion of the detector illustrated in FIG. 1;

DETAILED DESCRIPTION OF THE PREFERRED EMBODIMENTS

Figures 1, 1A:
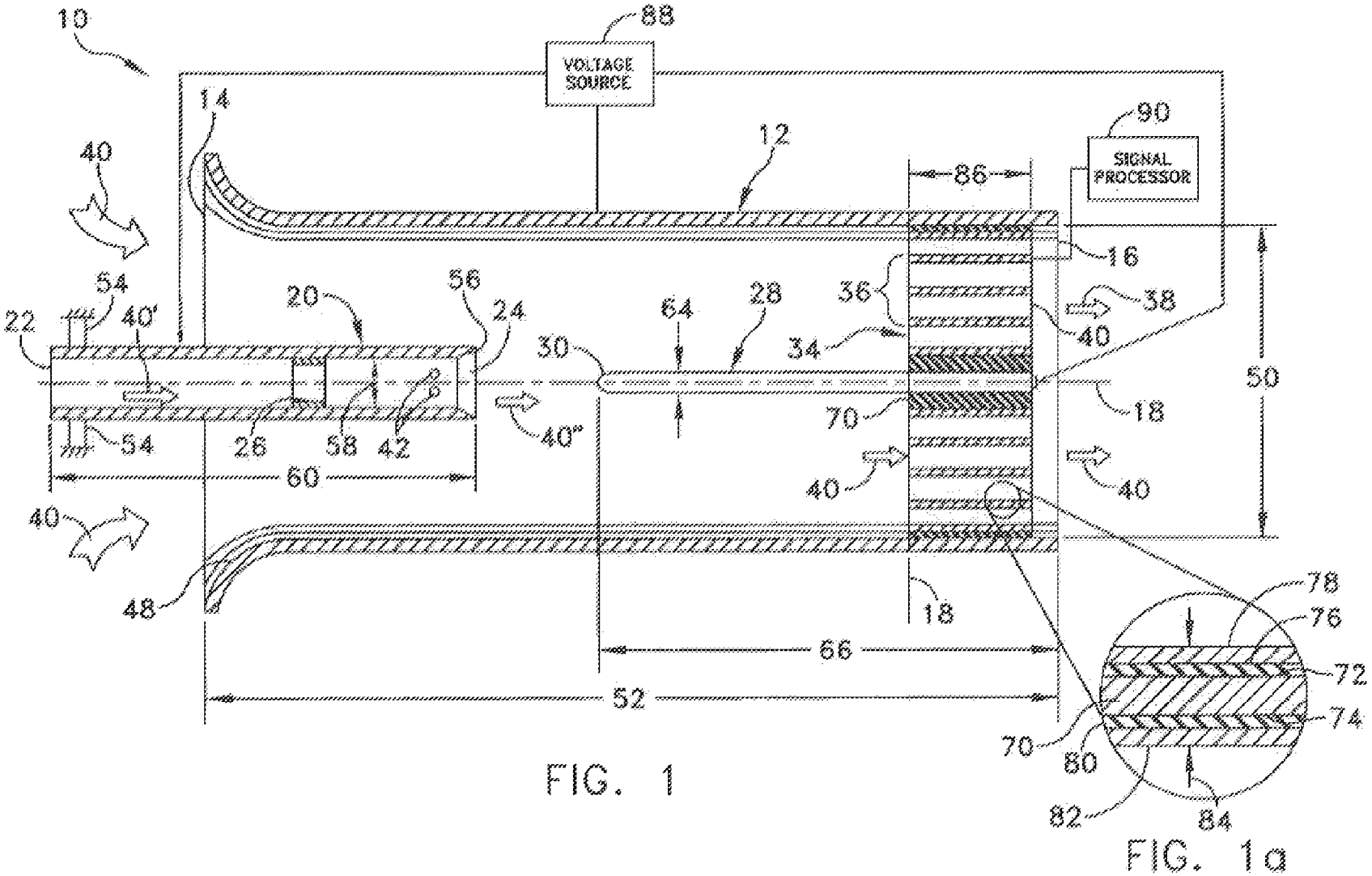
FIG. 1 is a cross-sectional view in elevation of an axisymmetric embodiment of an ion mobility spectrometer according to the teachings of the present invention.
Figure 2:
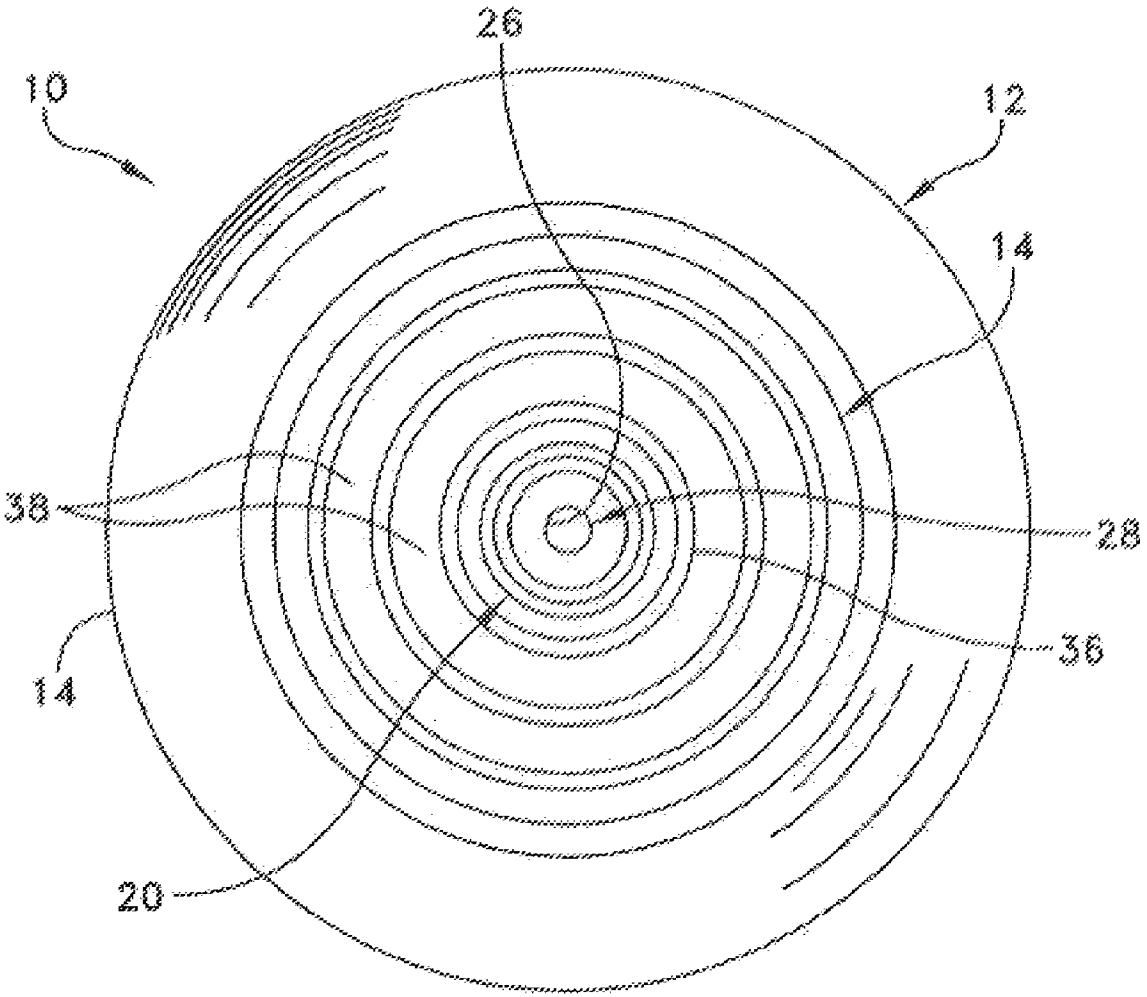
FIG. 2 is an end view of the axisymmetric ion mobility spectrometer illustrated in FIG. 1.

An ion mobility spectrometer 10 according to one embodiment of the present invention is best seen in FIGS. 1-4 and may comprise a flow channel 12 having an inlet end 14 and an outlet end 16. In this particular embodiment, flow channel 12 comprises a axisymmetric member, such as a cylinder, that is generally symmetrical about a longitudinal axis 18. Alternatively, other configurations are possible, as will be described in greater detail below. Ion mobility spectrometer 10 may also be provided with an ion tunnel 20 positioned within the flow channel 12 so that respective inlet and outlet ends 22 and 24 of ion tunnel 22 are oriented in the same general directions as the inlet and outlet ends 14 and 16 of flow channel 12. Ion tunnel 20 may be provided with an ionization device 26 or other means for ionizing atoms or molecules of a sample material (not shown) provided to ion mobility spectrometer 10. Ion mobility spectrometer 10 may also include a deflection electrode 28 positioned within the flow channel 12 so that a leading edge 30 of deflection electrode 28 is located at a position downstream from the ion tunnel 20.

Figure 3:
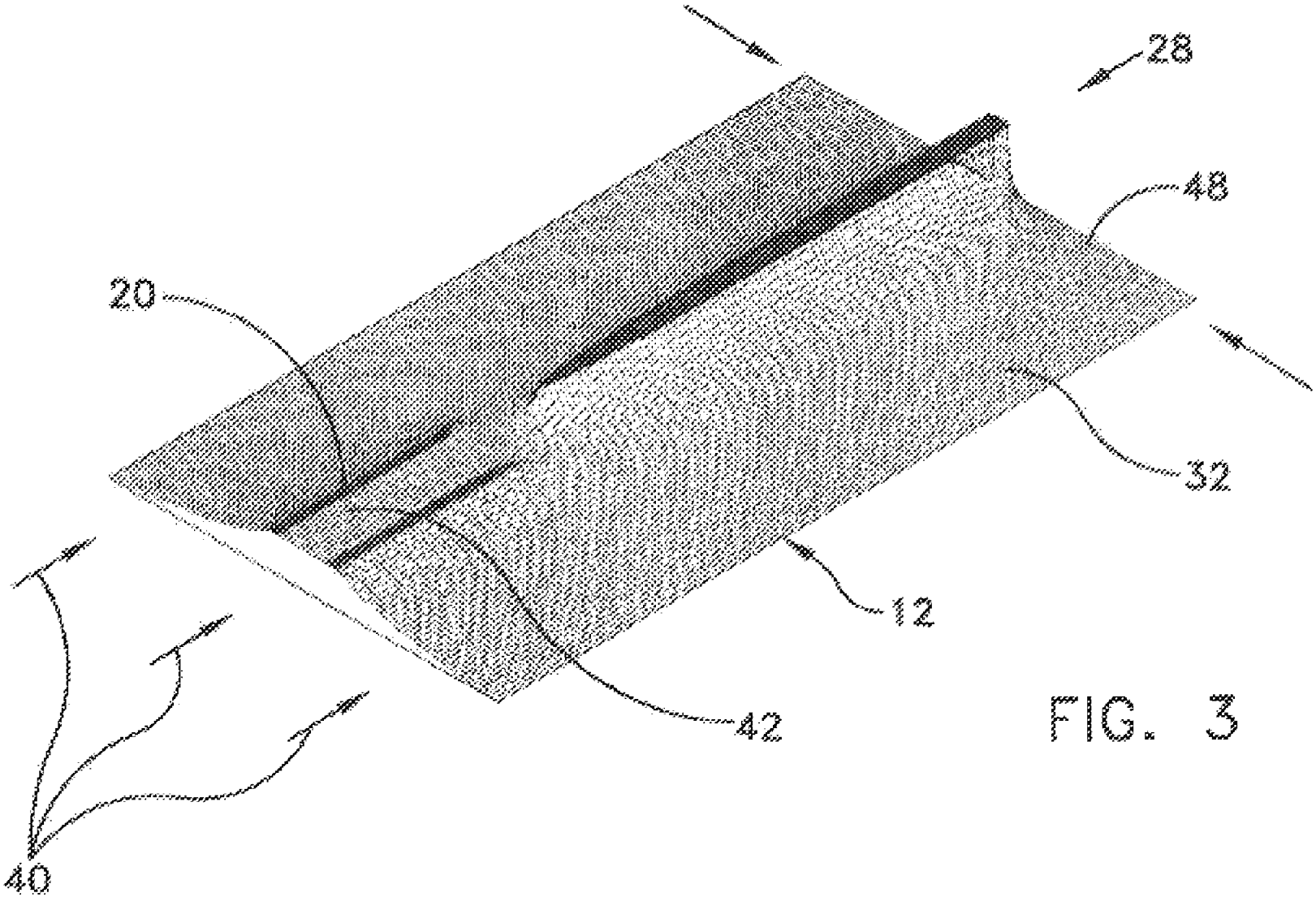
FIG. 3 is a computer simulated potential energy view of a non-linear electrostatic field that may be produced by the ion mobility spectrometer illustrated in FIG. 1.

Referring now primarily to FIG. 3, the arrangement of deflection electrode 28 within flow channel 12 is such that a non-linear electric field 32 is created or established between at least a portion of the flow channel 12 and at least a portion of the deflection electrode 28 when an electric potential is placed between deflection electrode 28 and flow channel 12. In the embodiment shown and described herein wherein the flow channel 12 comprises a generally cylindrically-shaped member, the non-linear electric field 32 will comprise a "second order" logarithmic field. That is, the electric potential of the field 32 decreases as a function of the square of the distance (i.e., radius) from the deflection electrode 28. Alternatively, other types of non-linear electrostatic fields are possible with appropriate changes to geometry and should be regarded as within the scope of the present invention.

The ion mobility spectrometer 10 may also be provided with a detector 34 positioned generally downstream from the leading edge 30 of deflection electrode 30. In one embodiment, detector 34 may comprise a plurality of electrostatic repulsion detectors 36 arranged in spaced-apart relation so that a gap 38 is defined between adjacent ones of the electrostatic repulsion detectors 36. Alternatively, other detector arrangements are possible, as will be described in greater detail herein.

The ion mobility spectrometer 10 may be used to perform ion mobility spectrometry on a substantially continuous basis, if desired, by establishing a flow of carrier gas 40 within flow channel 12. The carrier gas 40 may comprise, for example, air, and may contain entrained amounts of a sample material (not shown) to be analyzed by ion mobility spectrometer 10. The flow of carrier gas 40 may be established in any of a wide variety of ways. By way of example, in one embodiment, the flow of carrier gas 40 may be established by placing the ion mobility spectrometer 10 in a flow of air, such as for example, as may be accomplished by mounting the ion mobility spectrometer 10 to a moving vehicle (e.g, a car or an aircraft). Alternatively, a suitable fan or pump (not shown) operatively connected to either the inlet end 14 or outlet end 16 of flow channel 12 may be used to establish the flow of carrier gas 40. Generally speaking, in applications involving a pump or fan to establish the flow of carrier gas 40, it will be more advantageous to pull the carrier gas 40 through flow channel 12 rather than to push it through flow channel 12 in order to ensure a more uniform flow within flow channel 12.

Regardless of how the flow of carrier gas 40 is established within flow channel 12, a portion 40' of the carrier gas may be allowed to flow into the inlet end 22 of ion tunnel 20 whereupon atoms or molecules of the sample material entrained in carrier gas 40' will be ionized by ionizing device 26 to form ions 42. Alternatively, and as will be described in greater detail below, gas 40' need not comprise a portion of the carrier gas 40 but could instead comprise a gas that is chemically different from carrier gas 40, and could even be introduced into the inlet end 22 of ion tunnel 20 from a separate source.

In one embodiment, ionizing device 26 may comprise a radioactive isotope, such as $^{63}$Ni, suitable for ionizing atoms or molecules of the sample material entrained in carrier gas 40'. Thereafter, carrier gas 40" carrying ions 42 of the sample material will join the flow 40 in flow channel 12, as best seen in FIGS. 1 and 3.

After joining the flow of carrier gas 40 in flow channel 12, ions 42 of the sample material will be subjected to the non-linear (e.g., logarithmic, in the case of a spectrometer 10 comprising generally cylindrically shaped, coaxial electrodes 12 and 28) electric field 32 created between at least a portion of the deflection electrode 28 and at least a portion of flow channel 12. See FIG. 3. The combination of the flow of carrier gas 40 within flow channel 12 and the non-linear electric field 32 will cause the ions 42 to follow various ion trajectories or paths 44, illustrated in FIG. 4. The particular paths or trajectories 44 followed by the ions 42 will depend on the mobilities of the particular ions 42. For example, and as will be described in greater detail below, high mobility ions will be deflected further radially outwardly from deflection electrode 28, whereas ions having lower mobilities tend to remain closer to deflection electrode 28.

Figure 4:
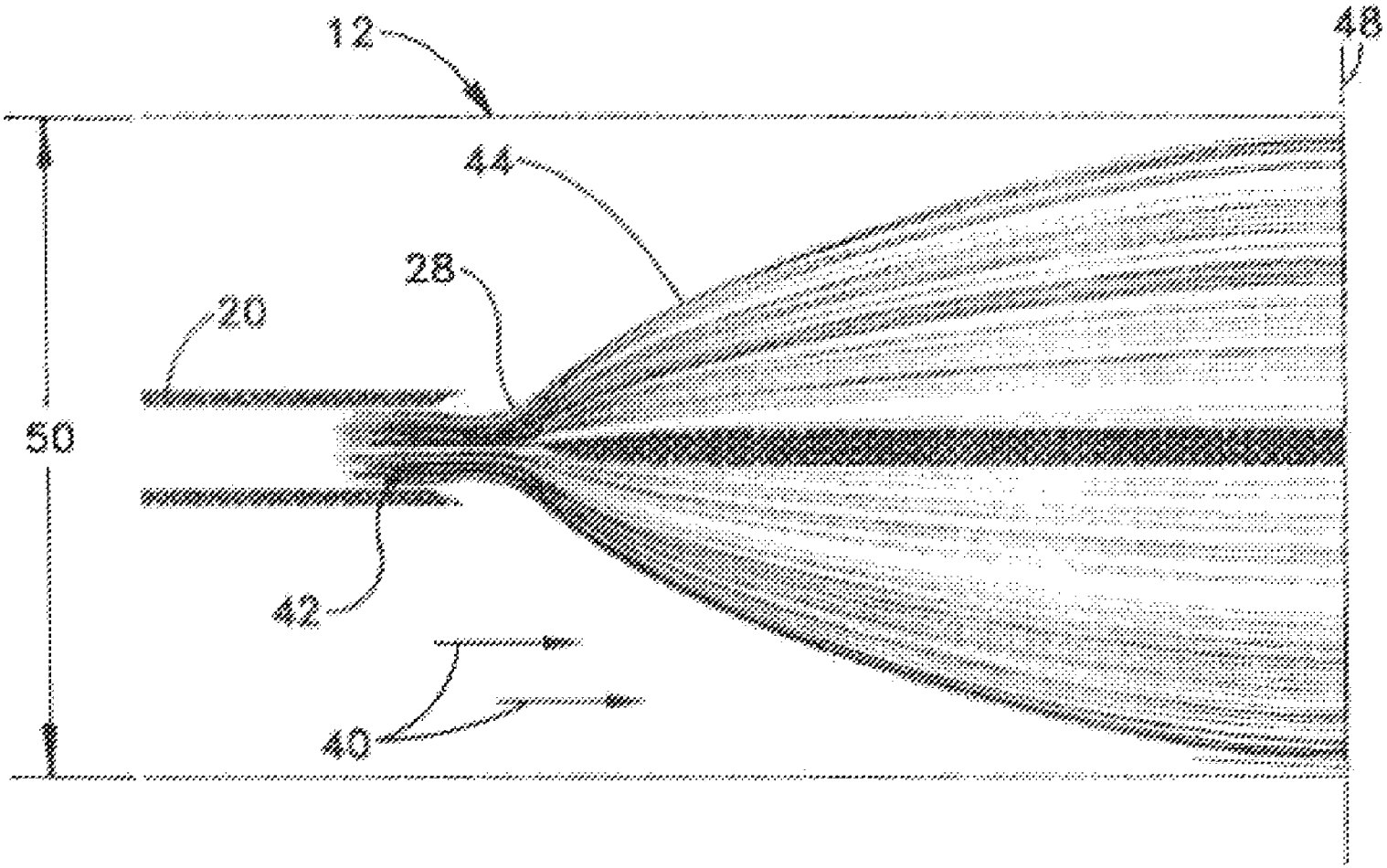
FIG. 4 is a computer simulated side view of ion trajectories in a non-linear electrostatic field of the type produced by the ion mobility spectrometer of FIG. 1.
Figure 5:
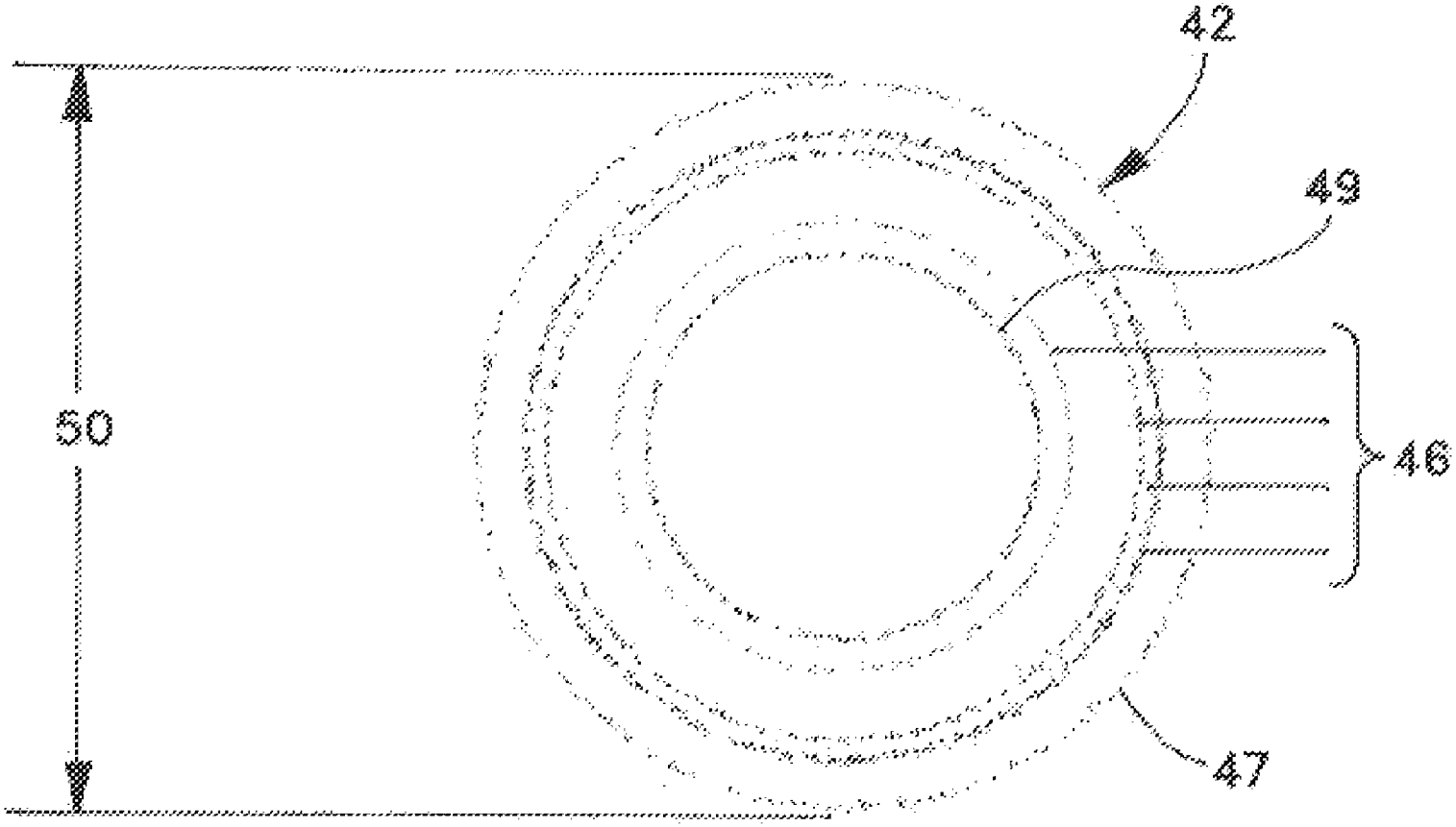
FIG. 5 is a computer simulated end view of ion trajectories in a non-linear electrostatic field of the type produced by the ion mobility spectrometer of FIG. 1 with electrodes at a first electric potential.
Figure 6:
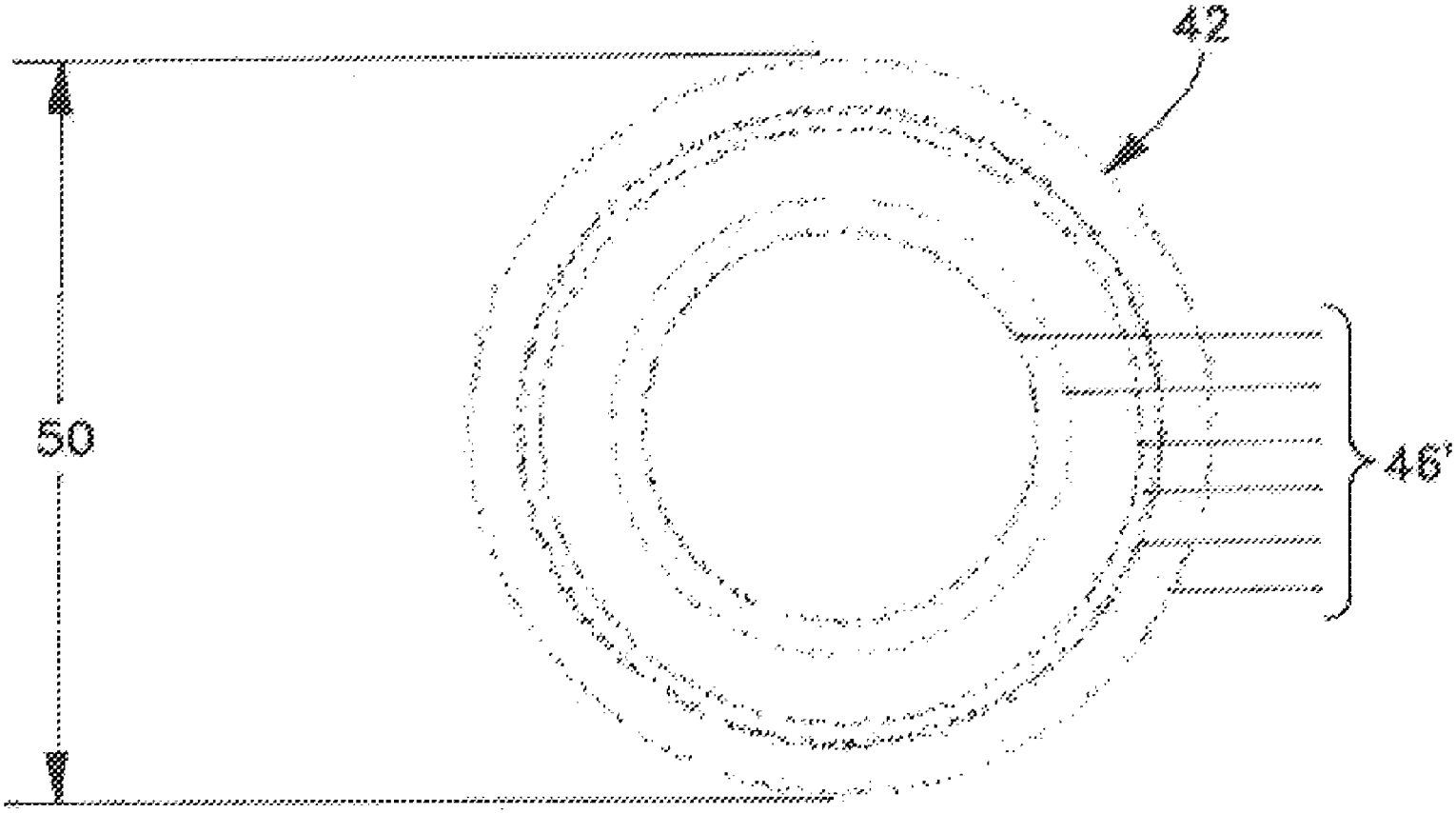
FIG. 6 is a computer simulated end view of ion trajectories in a non-linear electrostatic field of the type produced by the ion mobility spectrometer of FIG. 1 with electrodes at a second electric potential.

Referring now primarily to FIG. 5, and in an axisymmetric configuration, ions 42 from the non-linear electric field 32 will tend to form a plurality of concentric circles or rings 46 by the time the ions 42 reach detector plane 48 (FIGS. 1, 3, and 4). For example, a group of ions 42 having a high mobility may form an outermost ion ring 47, whereas a group of ions having a low mobility may form an innermost ion ring 49. Ions having intermediate mobilities will, of course, comprise various rings 46 between outermost ring 47 and innermost ring 49.

Detector 34 is configured to detect the circles or rings 46 of ions 42, thereby allowing ion mobility spectrometer 10 to distinguish between ions 42 having different mobilities as well as to assess the relative numbers of ions 42 (e.g., the proportions) of ions 42 having specific mobilities. In one embodiment, wherein detector 34 comprises a plurality of electrostatic repulsion detectors 36, rings 46 of ions 42 located at radial positions that correspond to the positions of the various detectors 36 will be detected. See FIG. 8. The gaps 38 between the detectors 36 allow the carrier gas 40 to exit the ion mobility spectrometer 10, as represented by arrows 40.

A significant advantage of the ion mobility spectrometer 10 of the present invention is that it allows for continuous flow ion mobility spectrometry to be performed. That is, ions can be continuously produced from the flow of carrier gas, separated by their mobilities, then detected, all in a substantially continuous manner. In addition, ion mobility spectrometer 10 allows ions of different mobilities to be detected in parallel. That is, high mobility ions can be detected at the same time as low mobility ions.

Additional advantages are associated with the non-linear electric field 32 created between deflection electrode 28 and flow channel 12. For example, the radial velocity component (i.e., the outward velocity) of an ion 42 located between the deflection electrode 28 and flow channel 12 is proportional to the inverse of the radial location of the ion 42. This varying velocity component will cause a ring 46 of identical ions 42 to pack and become thinner as the ring 46 expands radially outward, as best seen in FIGS. 3 and 4. The ion density also decreases as the rings 46 of ions 42 travel generally radially outward on the way toward detector 34, thereby reducing ion spread due to charge-repulsion effects. Consequently, the ion mobility spectrometer 10 according to the teachings of the present invention can realize substantial increases in resolution (i.e., the fractional resolving limit), compared with currently-available ion mobility spectrometers having linear electrostatic fields. Stated another way, the fractional resolving limit of an ion mobility spectrometer 10 according to the present invention is a function of the square of the radius of the flow channel 12, whereas the fractional resolving limit of a conventional drift-tube ion mobility spectrometer is a linear function of the drift length.

Besides the "ion packing" effect due to the electrostatic gradient, there is also a resolution enhancement that occurs with increasing flow velocity. For example, if both the flow velocity and electrostatic voltage potentials are increased proportionally, the positions of the rings 46 will be the same, but the ions 42 comprising the rings 46 will be more compact, because there is less time for the ions 42 to diffuse. The reduced diffusion also increases the resolution of the spectrometer 10.

With regard to space-charge tolerance, or sensitivity to charge-repulsion effects, computer modeling of the ion mobility spectrometer 10 of the present invention indicates that the present invention provides for an order-of-magnitude increase or more in space-charge tolerance over conventional designs. This tolerance increase is due to the gradual dispersion (i.e., reduction in ion density) as the ion rings 46 expand radially outwardly as they travel toward detector 34 (FIG. 3).

Having briefly described one embodiment of the ion mobility spectrometer 10 as well as one embodiment of a method for performing continuous ion mobility spectrometry, various embodiments of the apparatus and methods according to the present invention will now be described in detail. However, before proceeding with the description it should be noted that while the various embodiments are shown and described herein as they could be utilized in certain exemplary environments and operated in accordance with certain exemplary parameters (e.g., voltage gradients, carrier gases, flow rates, etc.), other environments and operational parameters are possible, as would become apparent to persons having ordinary skill in the art after having become familiar with the teachings provided herein. Consequently, the present invention should not be regarded as limited to the particular embodiments, environments, and operational parameters shown and described herein.

Referring back now to FIGS. 1 and 2, one embodiment 10 of an ion mobility spectrometer may comprise a flow channel 12 having an inlet end 14 and an outlet end 16. In one exemplary embodiment, flow channel 12 may comprise a generally cylindrically shaped structure that is substantially axisymmetric about longitudinal axis 18. Alternatively, other configurations are possible, as will be described in greater detail below. Inlet end 14 of flow channel 12 may comprise a rounded or gradually converging section 48 to ensure a more uniform flow of carrier gas 40 (e.g., air) within flow channel 12 and to reduce or eliminate the possibility of flow separation within flow channel 12. In addition, a flow straightener, such as a honeycomb material (not shown) may be positioned adjacent inlet end 14 to minimize flow perturbations within flow channel 12. However, because many different types of flow straighteners are known in the art and could be easily provided by persons having ordinary skill in the art after having become familiar with the teachings provided herein, the particular type of flow straightener that may be utilized in conjunction with the present invention will not be described in further detail herein. The outlet end 16 of flow channel 12 may comprise a generally straight section and may be sized to receive the detector 34, as illustrated in FIG. 1.

Flow channel 12 may comprise any of a wide range of sizes (e.g., lengths and diameters) depending on a number of factors, such as, for example, the particular application, flow speeds, and desired resolution of the ion mobility spectrometer 10, as would become apparent to persons having ordinary skill in the art after having become familiar with the teachings provided herein. Consequently, the present invention should not be regarded as limited to flow channels 12 having any particular dimensions. However, by way of example, in one embodiment, an inside diameter 50 of flow channel 12 may be about 100 mm (about 3.9 inches). Flow channel 12 may have an overall length 52 of about 91 cm (about 36 inches).

The thickness of the wall of flow channel 12 is not particularly critical and may comprise any of a wide range of thicknesses depending on the particular material used as well as the mechanical requirements of the particular application. Consequently, the flow channel 12 should not be regarded as limited to any particular wall thickness. However, by way of example, in one embodiment, flow channel 12 may have a wall thickness of about 0.7 mm (about 0.031 inches). Flow channel 12 may be fabricated from any of a wide range of electrically conductive materials (e.g., metals) suitable for the intended application. By way of example, in one embodiment, flow channel 12 is fabricated from brass. Alternatively, other metals, such as stainless steel, may be used as well.

Ion mobility spectrometer 10 may also comprise an ion tunnel 20 within which ions 42 of the sample material to be analyzed may be formed. Alternatively, and as will be described in further detail below, other methods and devices (e.g., laser ionization methods involving lasers) may be used to produce the ions 42. In the embodiment shown and described in FIGS. 1-4, ion tunnel 20 may comprise a generally cylindrically-shaped structure having an inlet end 22 and an outlet end 24. In one embodiment, ion tunnel 20 may be supported at a location outside flow channel 12 by a plurality of insulating support struts or "spiders" 54 so that ion tunnel 20 is generally aligned along longitudinal axis 18 and generally concentric with flow channel 12 in the manner best seen in FIGS. 1 and 2. Alternatively, other arrangements are possible. For example, in another embodiment, the ion tunnel 20 may be supported within the flow channel 12 by a plurality of radially oriented support struts, provided measures are taken to minimize flow perturbations within flow channel 12.

The inlet end 22 of ion tunnel 20 may comprise a substantially straight section, as shown in FIG. 1. Alternatively, inlet end 22 of ion tunnel 20 may comprise a rounded or converging section (not shown) similar to that of inlet end 14 of flow channel 12. Outlet end 24 of ion tunnel 20 may comprise a flared or tapered section 56 to provide a smooth transition for the flow of carrier gas 40" from ion tunnel 20 to join the flow of carrier gas 40 in the flow channel 12 with minimal disruption at the exit plane of ion tunnel 20.

Ion tunnel 20 may comprise any of a wide variety of sizes (e.g., diameters and lengths) depending on the particular application and, of course, the size of flow channel 12. Consequently, the ion tunnel 20 should not be regarded as limited to any particular size. However, by way of example, in one embodiment, ion tunnel 20 may have an inside diameter 58 of about 11.2 mm (about 0.44 inches). Length 60 of ion tunnel 20 may be about 122 cm (about 40 inches) which allows ion tunnel 20 to be supported (e.g., by support struts 54) at a position well-away from the inlet end 14 of flow channel 12, again to minimize flow perturbations within flow channel 12.

If the ion tunnel 20 is to be provided with a radioactive ionizing device 26, then length 60 of ion tunnel 20 may be selected so that it is about equal to, or even exceeds, the beta-effective range of the radioactive material for the particular carrier gas 40 being utilized. So selecting the length 60 of ion tunnel 20 to be equal to or greater than the beta effective range of the radioactive material used as ionizing device 26 will help to ensure that substantially all of the ionization occurs within ion tunnel 20. By way of example, in one embodiment, the radioactive material comprises $^{63}$Ni which has a beta-effective range (in air) of about 30 mm. Thus, it will be generally desirable to position the ionizing device 26 so that it is located at least about 30 mm upstream from the outlet end 24 of ion tunnel 20.

The wall thickness of ion tunnel 20 is not particularly critical so long as measures are taken to ensure that the carrier gas 40" can smoothly join the flow of carrier gas 40 within flow channel 12 as carrier gas 40" exits the ion tunnel 20. In one embodiment, a smooth transition may be accomplished by providing the outlet end 24 with a taper or bevel 56. Alternatively, the wall thickness of ion tunnel 20 could be made very thin to smooth the transition as flow 40" joins flow 40. By way of example, in one embodiment having a tapered or beveled portion 56 at outlet end 24, ion tunnel 20 may have a wall thickness of about 3.3 mm (about 0.133 inches). Ion tunnel 20 may be fabricated from any of a wide range of electrically conductive materials (e.g., metals) suitable for the particular application. By way of example, in one embodiment ion tunnel 20 is fabricated from stainless steel.

As mentioned, ion tunnel 20 may be supported at a location external to the flow channel 12 by one or more insulated support struts 54. So supporting the ion tunnel 20 will allow ion tunnel 20 to be placed at a different electrostatic potential than flow channel 12 and deflection electrode 28, as will be discussed in further detail below. Accordingly, the particular mounting arrangement should be capable of reliably sustaining the particular potential difference expected to be placed between ion tunnel 20 and flow channel 12 in the particular application. By way of example, in one embodiment, support members 54 may be fabricated from Teflon and may be provided at sufficient thickness to support the voltage potential (e.g., about 2,200 volts) expected to be placed between ion tunnel 20 and flow channel 12.

Ion tunnel 20 may also be provided with an ionizing device or element 26 capable of ionizing atoms or molecules of the sample material entrained in the carrier gas flow 40' entering ion tunnel 20. In one embodiment, ionizing element 26 may comprise a ring-shaped member having a radioactive isotope, such as $^{63}$Ni, provided thereon. $^{63}$Ni is a beta emitter and is thus capable of ionizing most sample materials expected to be used with the ion mobility spectrometer 10. Alternatively, other ionizing materials may be used, as would become apparent to persons having ordinary skill in the art after having become familiar with the teachings provided herein. The ring-shaped member may comprise a nickel alloy (e.g., nickel 200) and may be sized to be received by the ion tunnel 20. Alternatively, ionizing element 26 need not comprise a separate member and could instead comprise a portion of the ion tunnel 20 itself. That is, a suitable ionizing material (e.g., $^{63}$Ni) could be provided (e.g., deposited) directly on the inside surface of ion tunnel 20. Still other arrangements are possible, as would become apparent to persons having ordinary skill in the art after having become familiar with the teachings provided herein. Consequently, the present invention should not be regarded as limited to any particular ionizing element 26.

Deflection electrode 28 is also mounted within flow channel 12 so that deflection electrode 28 is generally aligned with longitudinal axis 18 and so that a leading edge 30 thereof is located generally downstream from the ion tunnel 20. In the embodiment illustrated in FIGS. 1-4, wherein the flow channel 12 and ion tunnel 20 comprise generally axisymmetric, cylindrically-shaped members, deflection electrode 28 may comprise an elongate rod-like member and may be positioned within flow channel 12 so that is generally concentric with both flow channel 12 and ion tunnel 20. See FIG. 2.

The generally cylindrical shape and concentric arrangement of flow channel 12, ion tunnel 20, and deflection electrode 28 means that the non-linear electric field 34 will take on a generally axisymmetric logarithmic configuration, as best seen in FIG. 3. The axisymmetric arrangement of flow channel 12, ion tunnel 20, and deflection electrode 28 will also result in a substantially uniform and axisymmetric flow field 62 (FIG. 7) of carrier gas 40, both of which will result in the formation of substantially concentric ion rings 46 (FIG. 5). Concentric ion rings 46 will result in improved sensitivity and resolution of ion mobility spectrometer 10.

Deflection electrode 28 may comprise any of a wide range of sizes (i.e., dimensions) depending on the particular application and the sizes of the various other components (e.g., flow channel 12 and ion tunnel 20) comprising ion mobility spectrometer 10. In one embodiment, an outside diameter 64 of deflection electrode 28 may be about 5.5 mm (about 0.216 inches). An overall length 66 of deflection electrode 28 may be about 25.4 cm (about 10 inches).

Leading edge 30 of deflection electrode 28 may comprise a generally tapered or rounded configuration to ensure a smooth flow of carrier gas 40 around deflection electrode 28 and to minimize the likelihood for flow separation near leading edge 30. Leading edge 30 of deflection electrode 28 should also be positioned a spaced-distance 68 from the outlet end 24 of ion tunnel 20. The length of spaced-distance 68 is not particularly critical, but should be sufficient to avoid significant distortions of the logarithmic electric field 34 (FIG. 3) in the region nearby the outlet end 24 of ion tunnel 20. Computer modeling of the type described hereinbelow may be used to evaluate a specific configuration to ensure the appropriate spaced-distance 68. In one example, spaced-distance 68 is selected to be about 11 mm (about 0.43 inches). Deflection electrode 28 may be fabricated of any of a wide variety of electrically conductive materials (e.g., metals) suitable for the particular application. In one embodiment, deflection electrode 28 is fabricated from stainless steel.

Deflection electrode 28 may be mounted within flow channel 12 by any of a wide variety of arrangements suitable for providing the required mechanical support for the deflection electrode 28 as well as for minimizing flow perturbations and allowing for the maintenance of the electrostatic potentials (e.g., about 3,700 volts) expected to be placed between the flow channel 12 and deflection electrode 28. In one embodiment, deflection electrode 28 is supported by a cylindrically-shaped insulating member 70 provided in detector 34. See FIG. 1.

Detector 34 may be positioned within the flow channel 12 so that at least a portion of the detector 34 is located downstream from the leading edge 30 of deflection electrode 28. The detector 34 should be configured to efficiently detect the ions 42 deflected by the non-linear electrostatic field 32. For example, in an embodiment wherein the ions 42 will be deflected to form a plurality of generally concentric ion rings 46 (FIG. 5), detector 34 may comprise a plurality of electrostatic repulsion detectors 36. Each electrostatic repulsion detector 36 may comprise an elongate, generally cylindrically shaped element. The various electrostatic detectors 36 may be provided with different diameters and may be mounted in a nested, generally concentric arrangement so that a gap 38 is formed between adjacent detectors 36. See FIGS. 1 and 2.

Each electrostatic repulsion detector 36 may comprise a laminated arrangement comprising a plurality of layers. For example, and with reference now to FIG. 1(*a*), each electrostatic repulsion detector 36 may comprise a ground plane layer 70 having a first side 72 and a second side 74. A first insulating layer 76 and a detector layer 78 are provided on the first side 72 of ground plane layer 70 so that the insulating layer 76 is located between ground plane layer 70 and detector layer 78. A second insulating layer 80 and a repulsion layer 82 are provided on the second side 74 of ground plane layer 70 so that the insulating layer 80 is located between ground plane layer 70 and repulsion layer 82.

The various layers 70, 76, 78, 80, and 82 comprising electrostatic repulsion detector 36 may comprise any of a wide range of materials suitable for their intended purposes (i.e., either conductors or insulators, as the case may be) and on the particular application. Consequently, the various layers comprising electrostatic repulsion detector 36 should not be regarded as limited to any particular types of materials. By way of example, in one embodiment, ground plane layer 70 as well as detector and repulsion layers 78 and 82 may comprise copper. Insulating layers 76 and 80 may comprise a polyamide material. Generally speaking, it will be desirable to make the various layers 70, 76, 78, 80 and 82 of each electrostatic repulsion detector 36 as thin as possible in order to allow a meaningful number of detectors 36 to be nested together while still providing for gaps 38 of sufficient size to allow the flow of carrier gas to pass through detector 34. By way of example, in one embodiment, the overall thickness 84 of the laminated structure comprising each electrostatic repulsion detector 36 is about 1.165 mm (about 0.065 inches). The overall length 86 of each electrostatic repulsion detector 36 is about 256 mm (about 10 inches). The gap 38 separating adjacent ones of the electrostatic repulsion detectors 36 is about 8 mm (about 0.3 inches).

The various elements (e.g., electrodes) 12, 20 and 28 comprising the ion mobility spectrometer 10 may be connected to a voltage source 88 capable of placing the desired voltage potentials on the various elements to achieve the operational states described herein. Voltage source 88 may comprise any of a wide range of systems and devices currently known in the art or that may be developed in the future that are, or would be, capable of providing the desired voltage potentials on the various elements in accordance with the teachings provided herein. However, because voltage sources suitable for placing voltage potentials on elements (i.e., electrodes) of ion mobility spectrometers are well-known in the art and could be readily provided by persons having ordinary skill in the art after having become familiar with the teachings provided herein, the particular voltage source 88 that may be utilized in conjunction with the ion mobility spectrometer 10 will not be described in further detail herein.

The various detector layers 78 comprising detector 34 may be connected to a signal processing system 90 suitable for detecting ions 42 impinging the various detector layers 78 of electrostatic repulsion detectors 36. Signal processing system 90 may comprise any of a wide range of systems and devices currently known in the art or that may be developed in the future that are, or would be, capable of detecting signals from the various layers 78 comprising detector 34 and processing those signals so that meaningful information regarding the impact of ions 42 may be obtained. However, because signal processing systems suitable for use with detectors in ion mobility spectrometers are well-known in the art and could be readily provided by persons having ordinary skill in the art after having become familiar with the teachings provided herein, the particular signal processing system 90 that may be utilized in conjunction with the ion mobility spectrometer 10 will not be described in further detail herein.

In order to prepare the ion mobility spectrometer 10 for operation, the voltage source 88 may be operated to place various voltage potentials on the various elements (i.e., electrodes) 12, 20, and 28 to establish the non-linear electrostatic field 32. For example, in an embodiment comprising generally cylindrically shaped, concentric members, the non-linear electric field 32 may be made to comprise a second order logarithmic electrostatic field 32 (FIG. 3) by placing the appropriate electrical potentials on the various elements. For example, a second order logarithmic electrostatic field 32 may be created by grounding (e.g., placing a ground potential on) the flow channel 12, biasing the ion tunnel 20 at a potential of about 2,200 volts (relative to flow channel 12), and biasing the deflection electrode 28 at a potential of about 3,700 volts (relative to flow channel 12). Of course, either positive or negative potentials (with respect to ground) may be used depending on whether positively-charged or negatively-charged ions are to be detected, as would become apparent to persons having ordinary skill in the art after having become familiar with the teachings provided herein.

A schematic representation of a second order logarithmic electrostatic (i.e., non-linear) field 32 resulting from the potential electrostatic gradients described above is illustrated in FIG. 3. The electrostatic field 32 represented in FIG. 3 was generated by a computer modeling program known as "SIMION 7.0" which is available from Scientific Instruments Services, Inc., 1027 Old York Road, Ringoes, N.J. 08551 (USA). The computer modeling is based on the ion mobility spectrometer 10 having the electrode configurations and dimensions shown and described herein. In addition, the electric fields and ion movements depicted in FIGS. 4-6 and 8 were also derived from the SIMION 7.0 computer program in conjunction with the Statistical Diffusion Simulation (SDS) user program package, which is available as supplementary material associated with the following journal article: Appelhans, A. D.; Dahl, D. A., "SIMION Ion Optics Simulations at Atmospheric Pressure," *International Journal of Mass Spectrometry* 2005, 244, 1-14, which is incorporated herein by reference for all that it discloses. The SDS package accounts for the gas flow field as part of the simulation and will accept velocity flow parameters. A computer modeling package known as COSMOSFloWorks was used to simulate the flow of carrier gas through the model and to provide the input for the flow field used by SIMION with the SDS package. COSMOSFloWorks is available from SolidWorks Corporation of Concord, Mass. (USA). COSMOSFloWorks was also used to generate the flow field depicted in FIG. 7.

Referring now primarily to FIG. 3, the electrostatic field 32 created between the deflection electrode 28 and flow channel 12 is logarithmic. More specifically, the voltage gradient is inversely proportional to the distance (i.e., radius) between the deflection electrode 28 and the flow channel 12. This results in the field voltage varying logarithmically with the radius. Note that in the embodiment illustrated in FIG. 3, an electrostatic potential is also placed on the ion tunnel 20. Placing a potential on ion tunnel 20 aids in the release of ions 42 from tunnel 20. That is, if the electrostatic potential between the deflection electrode 28 and ion tunnel 20 is too great for a specified operational condition, the resulting electric field will block or prevent ions 42 from exiting ion tunnel 20. Of course, this blocking effect could be used to advantage if it is desired to temporarily prevent ions 42 from entering the electric field 32.

As mentioned above, the logarithmic electric field 32 illustrated in FIG. 3 is only one example of a non-linear electrostatic field that may be produced by the present invention. Other types of non-linear, though not necessarily logarithmic, electric fields are possible and may be utilized in spectrometers having alternative configurations, as would become apparent to persons having ordinary skill in the art after having become familiar with the teachings provided herein.

Consequently, the present invention should not be regarded as limited to the particular types of non-linear electric fields shown and described herein.

Ion mobility spectrometer 10 may be operated as follows to detect ions 42 of a sample material entrained in a carrier gas 40, such as air. A flow of carrier gas 40 may be established in the flow channel 12 by means of relative motion between flow channel 12 and the carrier gas 40. Alternatively, a fan or pump operatively connected to the outlet end 16 of flow channel 12 may be used to initiate the flow of carrier gas 40 within the flow channel.

As mentioned above, a portion of the flow of carrier gas 40 may be allowed to enter inlet end 22 of ion tunnel 20 as carrier gas stream 40'. If so, carrier gas stream 40" (containing ions 42) will rejoin the flow of carrier gas 40 within flow channel 12 upon emerging from outlet end 24 of ion tunnel 20. Alternatively, other arrangements are possible. For example, in another embodiment, carrier gas stream 40' allowed to enter the inlet end 22 of ion tunnel 20 could be provided from a separate source (not shown), even though it may comprise the same material. If so, the flow rate of carrier gas 40' from the separate source could be adjusted to allow a smooth transition between the flow 40" emerging from outlet end 24 of ion tunnel and the flow 40 contained in flow channel 12. Moreover, the carrier gas 40' need not comprise the same material as carrier gas 40, but instead could be entirely chemically different or may comprise certain constituents that are chemically different than the constituents of carrier gas 40. Consequently, the present invention should not be regarded as limited to identical carrier gases 40, 40' and 40" nor carrier gases 40 and 40' originating from the same location.

Figure 7:
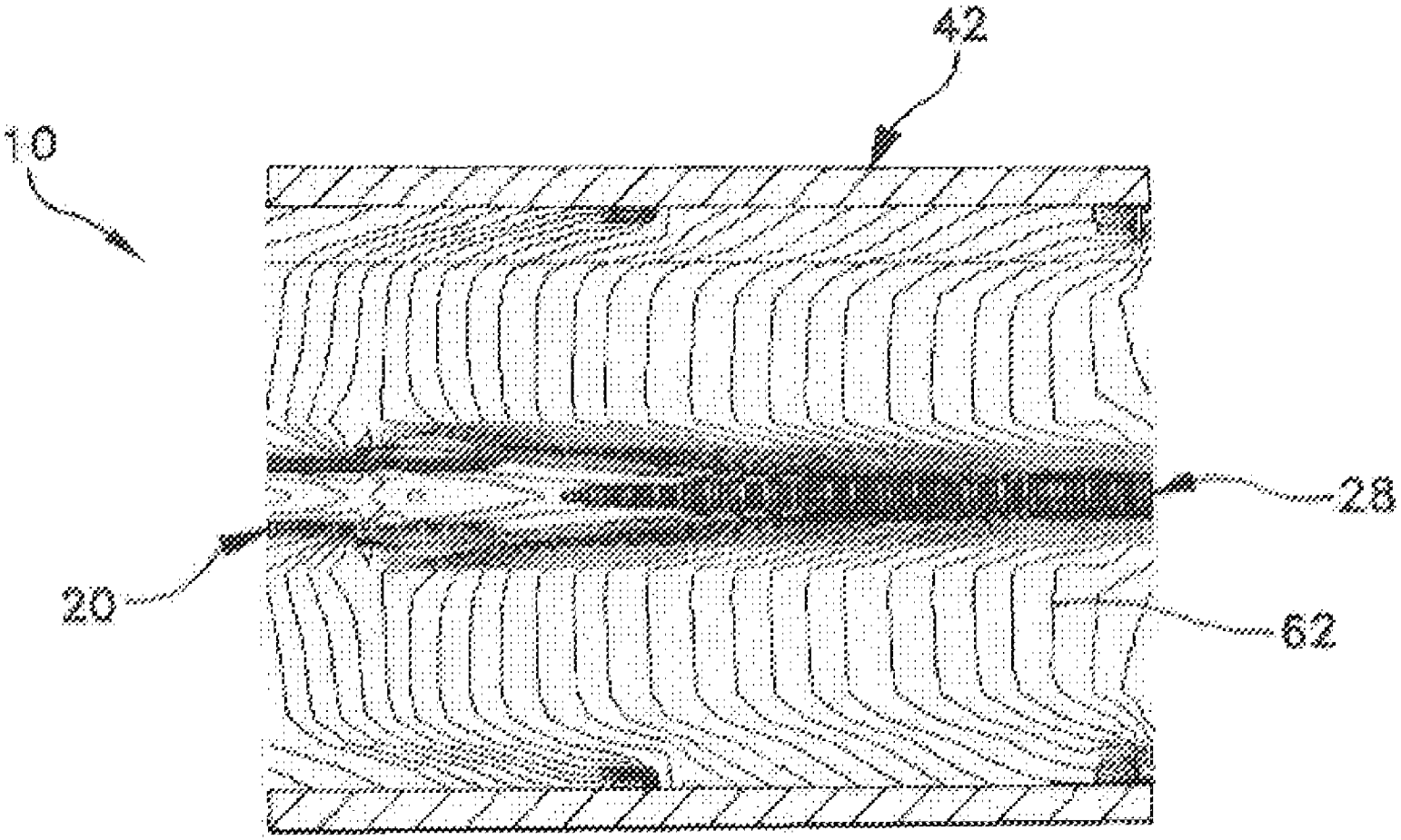
FIG. 7 is a computer simulated side view of a flow field in the flow channel of the ion mobility spectrometer of FIG. 1.

The velocity or speed of the carrier gas 40 within the flow channel 12 may be selected to be any of a wide range of speeds depending on the particular application. Generally speaking, flow velocities of at least about 10 meters/second (m/s) and more specifically greater than about 30 m/s will be suitable for many applications. A computer simulation of a flow field 62 resulting from a flow of air at about 30 m/s is illustrated in FIG. 7.

It should be noted that higher flow speeds will generally require larger electrostatic gradients if ions 42 having the same mobility are to be detected at about the same radial position on detector 34. Alternatively, higher speeds may be utilized if smaller radial displacements of ions 42 with given mobilities is acceptable. Stated another way, the ion mobility spectrometer 10 can be tuned to detect ions 42 with certain mobilities by changing the flow speeds and/or electric potentials utilized in the ion mobility spectrometer 10. In addition, computer modeling reveals that higher velocity flows and higher electric potentials will result in narrower ion bands 46, thus increasing the resolution of the ion mobility spectrometer. More specifically, the ion bands 46 illustrated in FIG. 5 resulted from a flow velocity of 30 m/s, and electric potentials of 2,200 volts and 3,700 volts, respectively, on the ion tunnel 20 and deflection electrode 28. However, increasing the flow velocity to 300 m/s and increasing the potentials on the ion tunnel 20 and deflection electrode 28 to 22,000 volts and 37,000 volts, respectively, results in the narrowed ion bands 46' illustrated in FIG. 6 for ions of the same mobility.

Once the flow of carrier gas 40 is established at the desired velocity and after the desired electrical potentials have been placed on the flow channel 12, ion tunnel 20, and deflection electrode 28 by voltage source 88, some of the carrier gas 40' will enter the inlet end 22 of ion tunnel 20. Upon entering ion tunnel 20, entrained amounts of sample material contained in carrier gas 40' will be ionized by ionization device 26 located within ion tunnel 20. More specifically, in one embodiment wherein ionization device 26 comprises nickel-63, beta radiation from the ionization device 26 will begin to ionize the sample material, resulting in the formation of ions 42 within ion tunnel 20. As mentioned above, the beta-effective ionization range (in air) for nickel-63 is about 30 mm. Therefore, the ion formation region within ion tunnel 20 may be regarded to be co-extensive with this length.

Ions 42 will remain entrained in the carrier gas and will exit ion tunnel 20 as carrier gas stream 40". Referring now primarily to FIG. 4, ions 42 exiting ion tunnel 20 will begin to be deflected by the non linear (e.g., logarithmic in one embodiment) electric field 32 established between deflection electrode 28 and flow channel 12. Ions 42 so entering the non-linear (e.g., logarithmic in one embodiment) electric field 32 will begin to drift outwardly in a radial direction. At the same time, the continuing flow of carrier gas 40 within flow channel 12 will begin to carry the ions 42 toward detector 34. That is, ions 42 will follow the various ion paths 44 illustrated in FIG. 4. As they traverse the drift region between the leading edge 30 of deflection electrode 28 and the detector 34, the ions 42 will begin to coalesce into ion rings 46, as best seen in FIG. 5. As mentioned, less mobile ions will tend to remain close to the deflection electrode 28 (i.e., will comprise inner rings 46, such as ring 49), whereas more mobile ions 42 will comprise the outer rings 46 (such as ring 47). Ions 42 having intermediate mobilities will, of course, comprise ion rings 46 between outer ring 47 and inner ring 49.

Figure 8:
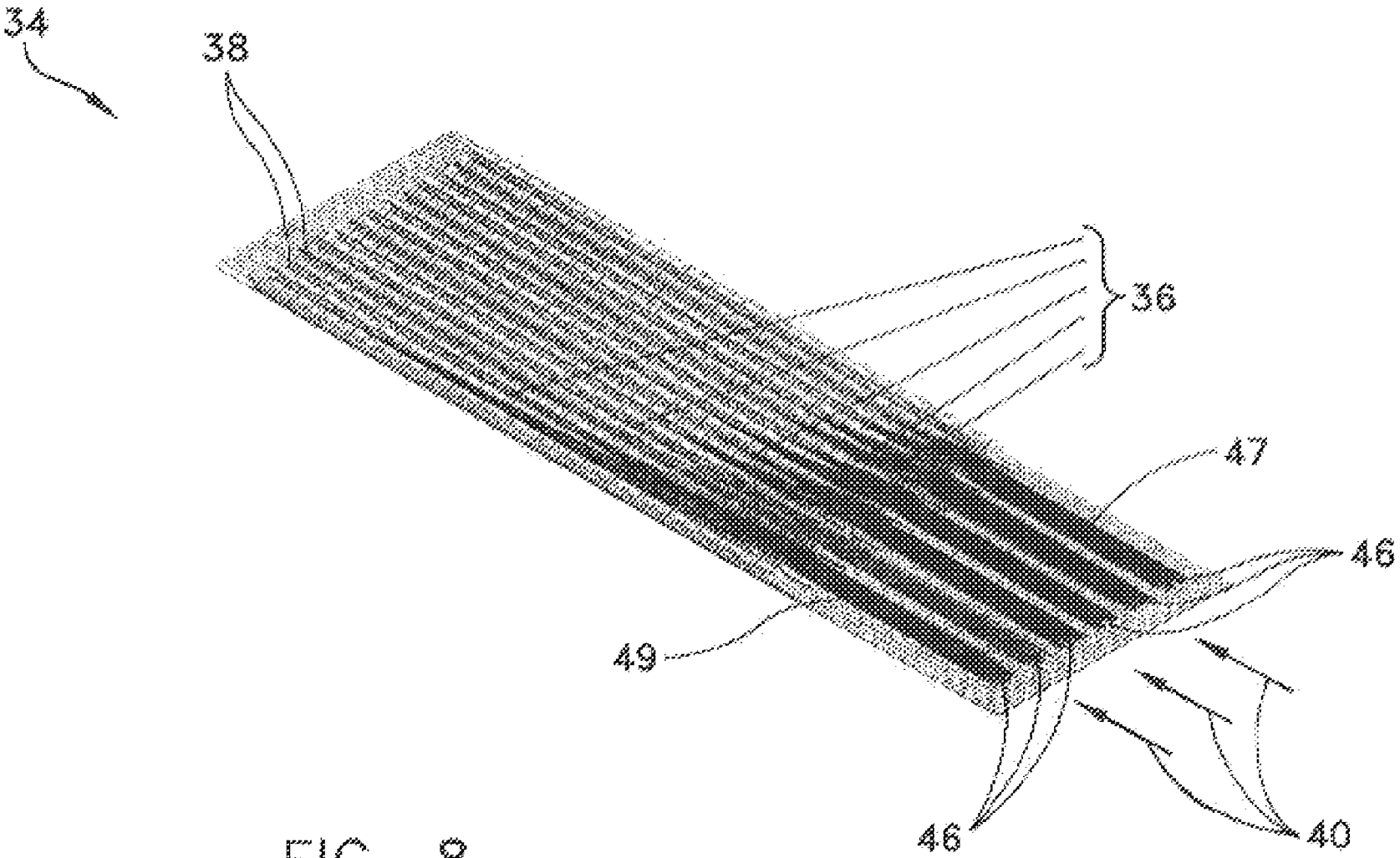
FIG. 8 is a computer simulated perspective view of ion paths in electrostatic repulsion detector rings.

The electrostatic repulsion detectors 36 may be used to detect the ions 42 contained in the various rings 46. Referring now to FIGS. 1*a* and 8, each of the electrostatic repulsion detectors 36 may be electrically biased (e.g., by voltage source 88 or by signal processor 90) so that the repulsion layer 82 repels ions 42 toward the detector layer 78 of an adjacent detector 36. Ion impacts on the various detector layers 78 may then be detected and processed by signal processing system 90. In the embodiment shown and described herein, both the ground plane layer 70 and detector layer 78 (FIG. 1*a*) of each electrostatic repulsion detector 36 are biased at a ground potential, whereas the repulsion layer 82 of each detector 36 is biased at about 100 volts. Alternatively, other electrostatic potentials may be utilized, as would become apparent to persons having ordinary skill in the art after having become familiar with the teachings provided herein. Voltage source 88 may be used to provide the required biasing of the various conductive layers of electrostatic repulsion detector 36. Alternatively, the biasing could be provided by signal processor 90.

Figure 9:
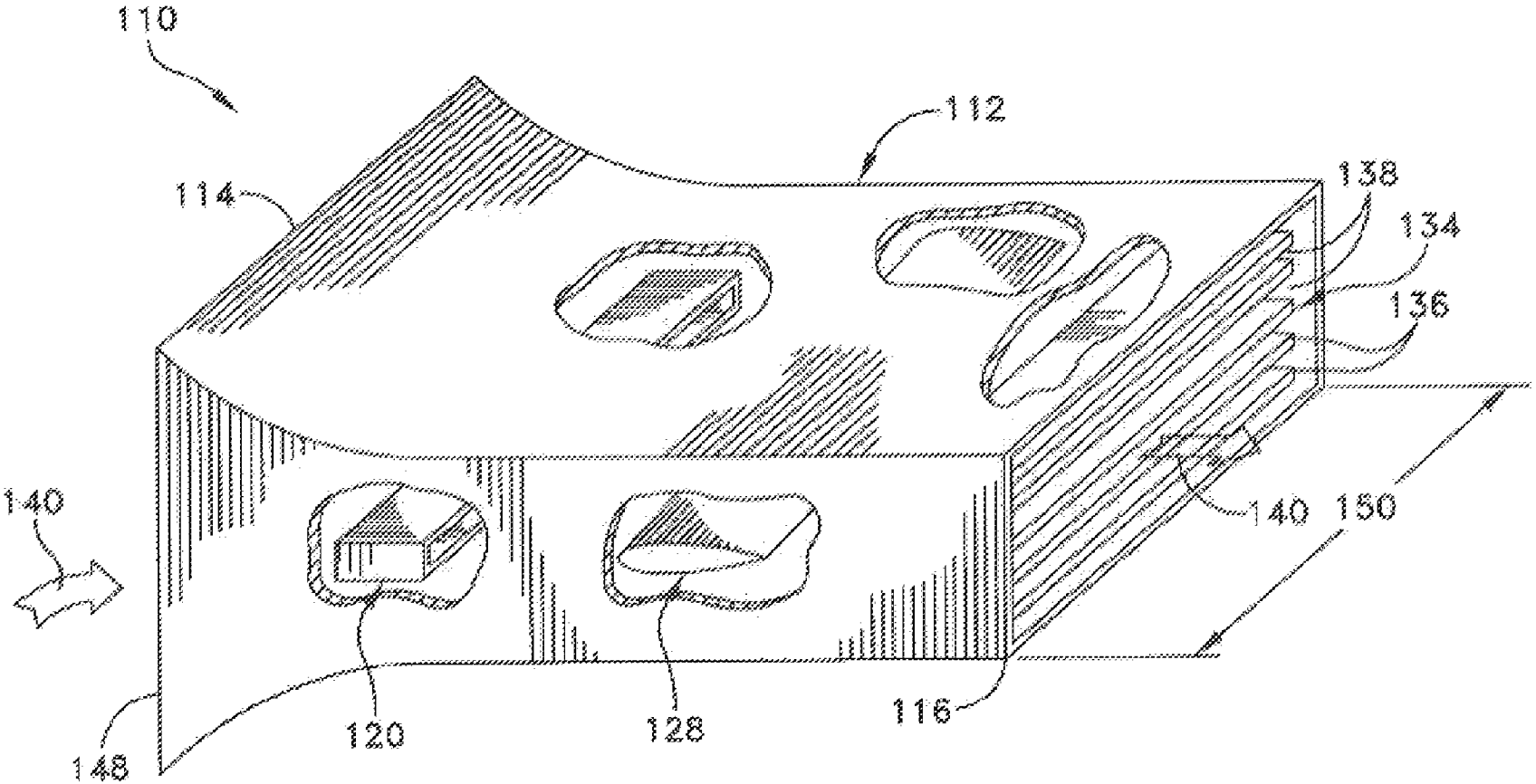
FIG. 9 is a perspective view of a second embodiment of an ion mobility spectrometer according to the teachings of the present invention.

As already mentioned, other embodiments of ion mobility spectrometer apparatus are possible and should be regarded as being within the scope of the present invention. For example, another embodiment 110 of ion mobility spectrometer apparatus according to the present invention is illustrated in FIG. 9 and may comprise a "two-dimensional" or plane-symmetric, as opposed to an axisymmetric, configuration. More specifically, ion mobility spectrometer 110 may comprise a flow channel 112 having a generally rectangularly-shaped cross-section. Inlet end 114 of flow channel 112 may comprise a flared or converging section 148 to smooth the flow of carrier gas 140 into the inlet end 114. Ion mobility spectrometer 110 may also be provided with an ion tunnel 120. Ion tunnel 120 may comprise a generally rectangularly-shaped cross-section, as illustrated in FIG. 9, although ion tunnels having other cross-sectional shapes are possible. Ion tunnel 120 may extend along substantially the entire width 150 of flow channel 112, although this is not required. As was the case for the first embodiment 10, the ion tunnel 120 of second embodiment 110 may be provided with an ionization device (not shown in FIG. 9) within ion tunnel 120 suitable for ionizing atoms or molecules of sample material entrained with carrier gas flow 140. By way of example, in one embodiment, the ionization device may comprise $^{63}$Ni provided within ion tunnel 120.

Ion mobility spectrometer 110 may also be provided with a deflection electrode 128. In the embodiment illustrated in FIG. 9, deflection electrode 128 comprises a cross-section having an air-foil shape, thus imparting electrode 128 with a wing-shaped configuration. Alternatively, other shapes are possible, as would become apparent to persons having ordinary skill in the art after having become familiar with the teachings provided herein. Electrode 128 may extend along substantially the entire width 150 of flow channel 112, although this is not required. A detector 134 may be positioned at about the outlet end 116 of flow channel 112 and may also extend along the entire width 150 of flow channel 112.

In the embodiment shown and described herein, detector 134 may comprise a plurality of electrostatic repulsion detectors 136 in the form of a plurality of plate-like members, each of which is separated from an adjacent electrostatic repulsion detector 136 by a gap 138. Each electrostatic repulsion detector 136 may have a layered construction that is substantially identical to the layered construction for each electrostatic repulsion detector 36 described above and illustrated in FIG. 1(*a*).

Figure 10:
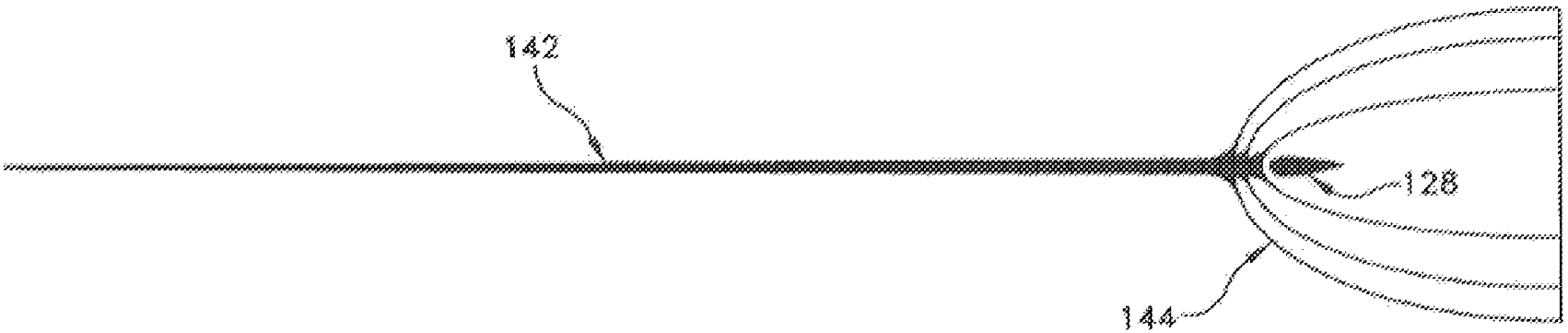
FIG. 10 is a computer simulated side view of ion trajectories in a non-linear electrostatic field of the type produced by the ion mobility spectrometer of FIG. 9.

Ion mobility spectrometer 110 may be operated in a manner similar to that described above for ion mobility spectrometer 10 by establishing an electrostatic potential between the deflection electrode or wing 128, ion tunnel 120, and flow channel 112. Thereafter, a flow of carrier gas 140 may be established in accordance with the teachings provided herein. The sample material to be analyzed will become ionized as it passes through ion tunnel 120 and will thereafter be deflected by deflection electrode or wing 128. The ion paths 144 followed by ions 142 are depicted in FIG. 10, which was produced by the SIMION and SDS computer programs discussed hereinabove. As can be seen in FIG. 10, ions 142 are deflected by varying amounts depending on their mobilities. Ions 142 having lower mobilities will tend to remain closer to middle portion of flow channel 112, whereas higher mobility ions 142 will tend to be deflected toward the upper and lower walls of flow channel 112. The ions 142 are thereafter detected by the various plate-like electrostatic repulsion detectors 136 in the manner already described for the axisymmetric embodiment 10.

Figure 11:
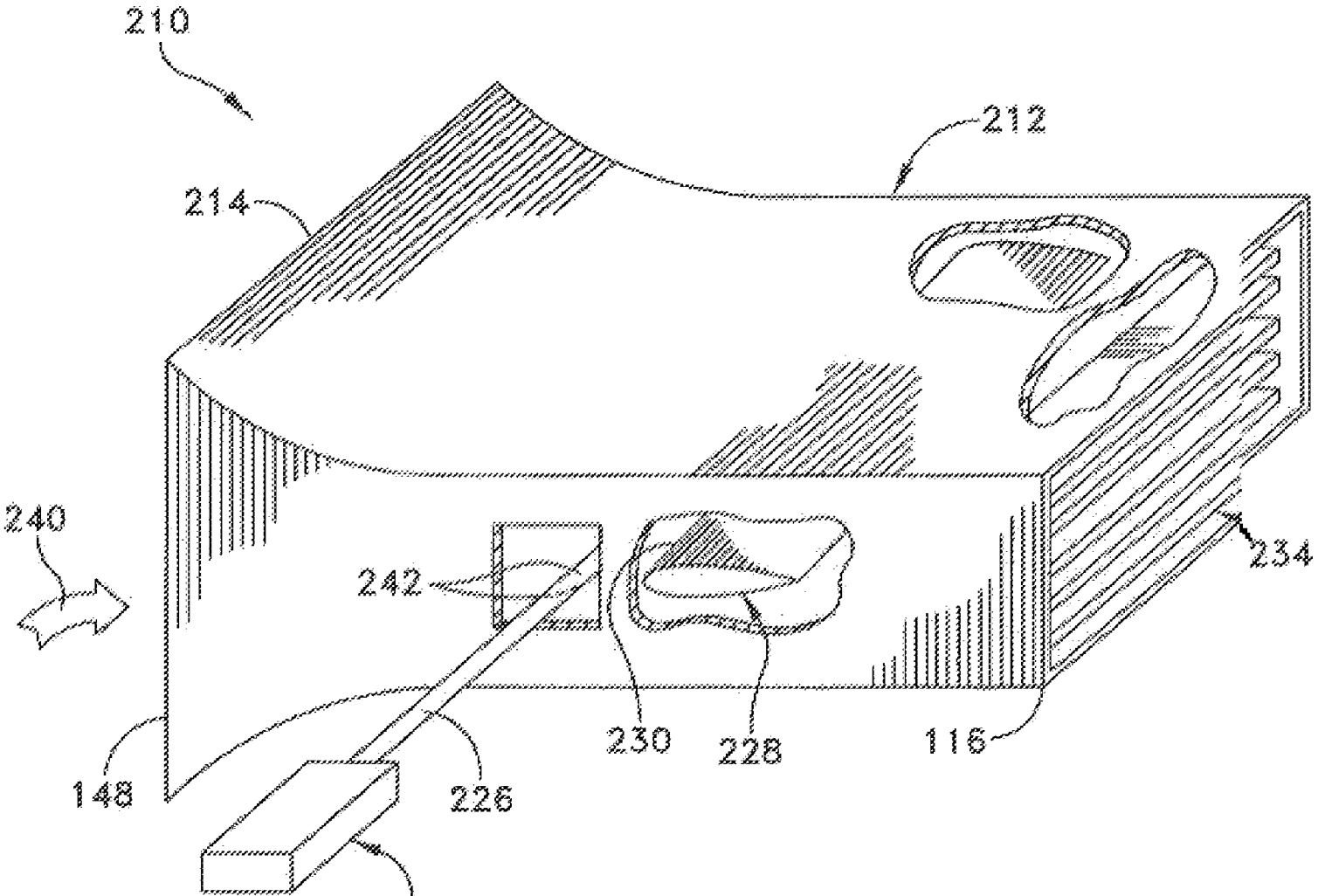
FIG. 11 is a perspective view of a third embodiment of an ion mobility spectrometer according to the teachings of the present invention having a laser ionizing device.

It should be noted that the electrostatic field (not shown) produced in this embodiment will be non-linear, but not logarithmic. As mentioned above, a logarithmic electrostatic field is produced in embodiments comprising generally cylindrically shaped, coaxial electrodes. Other electrode geometries, such as the geometries associated with the embodiment illustrated in FIGS. 9-11 will result in generally non-linear fields with decreasing gradients outward, away from the deflection electrode, but that do not decrease in a logarithmic manner.

As mentioned above, other means for producing ions may be utilized to produce ions at positions upstream from the leading edge of the deflection electrode. For example, instead of utilizing an ion tunnel (e.g., 20, 120) and an ionizing element (e.g., 26) to ionize atoms or molecules of the sample material, another embodiment may utilize a laser to ionize atoms or molecules of the sample material. More specifically, and with reference now to FIG. 11, another embodiment 210 of an ion mobility spectrometer apparatus may be substantially identical to the embodiment 110 just described, except that the ion tunnel (e.g., 120) and associated ionizing device is replaced by a laser 220. Laser 220 produces a laser beam 226 at a position generally adjacent (e.g., in front of) the leading edge 230 of deflection electrode or wing 228. Laser beam 226 will ionize atoms or molecules of sample material entrained in a flow of carrier gas 240 to produce ions 242. Thereafter, ions 242 will be deflected by the non-linear electric field (not shown in FIG. 11) between deflection electrode or wing 228 and the flow channel 212, before being detected by detector 234. The remaining portions of the ion mobility spectrometer 210 may be substantially identical to those described above for embodiments 10 and 110, thus will not be described in further detail herein.

In this regard, it should also be noted that the ion tunnel 20 and associated ionizing device 26 of first embodiment 10 could also be replaced by a laser (not shown in FIG. 1) for producing a laser beam at a position upstream from the leading edge 30 of deflection electrode 28, as would become apparent to persons having ordinary skill in the art after having become familiar with the teachings provided herein. Consequently, the present invention should not be regarded as limited to the particular means shown and described herein for producing ions at a position upstream from the leading edge of the deflection electrode.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. An ion mobility spectrometer, comprising:

a flow channel having an inlet end and an outlet end;

an ion tunnel positioned within said flow channel, said ion tunnel having an inlet end and an outlet end;

a deflection electrode positioned within said flow channel at a position downstream from said ion tunnel so that a leading edge of said deflection electrode is located a spaced distance from said ion tunnel, an electrostatic potential placed between said flow channel and said deflection electrode creating a non-linear electric field between at least a portion of said flow channel and at least a portion of said deflection electrode, ions exiting the outlet end of said ion tunnel being deflected by said deflection electrode into said non-linear electric field; and a detector, at least a portion of said detector being positioned downstream from the leading edge of said deflection electrode, said detector detecting ions from the non-linear electric field.

2. The ion mobility spectrometer of claim 1, wherein said flow channel comprises an axisymmetric member having a generally circular cross-section, said flow channel being generally aligned along a longitudinal axis, and wherein said ion tunnel comprises a generally axisymmetric member having a generally circular cross-section aligned along the longitudinal axis.

3. The ion mobility spectrometer of claim 2, wherein said deflection electrode comprises a generally elongate member generally aligned along the longitudinal axis.

4. The ion mobility spectrometer of claim 3, wherein said deflection electrode comprises a generally cylindrically shaped, rod like member and wherein said non-linear electric field comprises a logarithmic electric field.

5. The ion mobility spectrometer of claim 1, wherein said flow channel comprises a generally elongate member extending along a longitudinal axis.

6. The ion mobility spectrometer of claim 5, wherein said deflection electrode extends along a direction that is generally transverse to the longitudinal axis.

7. The ion mobility spectrometer of claim 6, wherein said flow channel comprises a cross-section having a generally rectangular shape.

8. The ion mobility spectrometer of claim 6, wherein said deflection electrode comprises a cross-section having a generally air-foil shape.

9. The ion mobility spectrometer of claim 1, wherein said detector comprises a plurality of electrostatic repulsion detectors positioned in spaced-apart relation so that a gap is defined between adjacent ones of said plurality of electrostatic repulsion detectors.

10. The ion mobility spectrometer of claim 9, wherein each of said plurality of electrostatic repulsion detectors comprises:

a ground plane layer having a first side and a second side;

a detector insulation layer provided on the first side of said ground plane layer;

a detector layer provided on said detector insulation layer;

a repeller insulation layer provided on the second side of said ground plane layer; and a repeller layer provided on said repeller insulation layer.

11. The ion mobility spectrometer of claim 1, wherein said detector comprises a plurality of plate-like members positioned in spaced-apart relation.

12. An ion mobility spectrometer, comprising:

a flow channel having an inlet end and an outlet end;

a deflection electrode having a leading edge, said deflection electrode being positioned within said flow channel, the arrangement of said flow channel and said deflection electrode being such that a non-linear electric field is created between at least a portion of said flow channel and at least a portion of said deflection electrode when an electrostatic potential is placed across said deflection electrode and said flow channel;

means for producing ions at a position upstream from the leading edge of said deflection electrode, ions from said means being deflected by said deflection electrode into the non-linear electric field; and detector means positioned within said flow channel for detecting ions from the non-linear electric field.

13. The ion mobility spectrometer of claim 12, wherein said means for producing ions comprises:

an ion tunnel having an inlet end and an outlet end, said ion tunnel being positioned within said flow channel at a location between the inlet end of said flow channel and said deflection electrode so that the outlet end of said ion tunnel is located adjacent the leading edge of said deflection electrode; and an ionizing device located adjacent the inlet end of said ion tunnel, said ionizing device ionizing atoms of a sample material within said ion tunnel.

14. The ion mobility spectrometer of claim 13, wherein said ionizing devices comprises a radioactive isotope.

15. The ion mobility spectrometer of claim 14, wherein said radioactive isotope comprises $^{63}$Ni.

16. The ion mobility spectrometer of claim 12, wherein said means for producing ions comprises a laser operatively associated with said ion mobility spectrometer, said laser producing a laser beam, said laser beam being directed adjacent the leading edge of said deflection electrode, said laser beam ionizing atoms of a sample material within said flow channel.

17. An ion mobility spectrometer, comprising:

a flow channel having an inlet end and an outlet end;

a deflection electrode having a leading edge, said deflection electrode being positioned within said flow channel, said flow channel and said deflection electrode being positioned so that a non-linear electric field is created between at least a portion of said flow channel and at least a portion of said deflection electrode when an electrostatic potential is placed across said deflection electrode and said flow channel;

a laser operatively associated with said ion mobility spectrometer, said laser producing a laser beam adjacent the leading edge of said deflection electrode, the laser beam ionizing sample material contained within said flow channel; and a detector positioned downstream from the leading edge of said deflection electrode, said detector detecting ions.

18. A method for performing ion mobility spectrometry, comprising:

establishing a flow of a carrier gas in a flow channel containing a deflection electrode, said carrier gas comprising entrained amounts of a sample material;

placing an electrostatic potential between the flow channel and the deflection electrode to produce a non-linear electric field between at least a portion of said deflection electrode and at least a portion of said flow channel;

ionizing at least a portion of the sample material entrained in said carrier gas at a position upstream from the deflection electrode to produce ions of said sample material in the flow of the carrier gas, said ions being carried in the flow of carrier gas and being deflected by the deflection electrode into the non-linear electric field; and detecting ions after said ions have traveled through at least a portion of said non-linear electric field.

19. The method of claim 18, wherein ionizing at least a portion of the sample material comprises directing at least a portion of the carrier gas adjacent a radioactive isotope.

20. The method of claim 19, wherein directing a portion of the carrier gas adjacent a radioactive isotope comprises directing a portion of the carrier gas adjacent $^{63}$Ni.

21. The method of claim 18, wherein ionizing at least a portion of the sample material comprises illuminating the carrier gas with photons.

22. The method of claim 21, wherein illuminating the carrier gas with photons comprises illuminating the carrier gas with a laser beam.

23. The method of claim 18, wherein establishing a flow of carrier gas comprises establishing a flow of air.

24. The method of claim 23, wherein establishing a flow of air comprises establishing a flow of air at a velocity of at least about 10 m/s.

25. The method of claim 23, wherein establishing a flow of air comprises establishing a flow of air at a velocity of at least about 30 m/s.

* * * * *